United States Patent [19]

Becker et al.

[11] 4,447,174

[45] May 8, 1984

[54] CAP POSITIONING MECHANISM

[75] Inventors: Kunibert Becker, Werl; Gerd Dunkel; Gunter Lagodka, both of Lunen; Rudiger Kirchbrucher, Dortmund-Brackel, all of Fed. Rep. of Germany

[73] Assignee: Gewerkschaft Eisenhutte Westfalia, Lunen, Fed. Rep. of Germany

[21] Appl. No.: 352,984

[22] Filed: Feb. 26, 1982

[30] Foreign Application Priority Data

Feb. 20, 1981 [DE] Fed. Rep. of Germany ..... 3107209

[51] Int. Cl.[3] ..... E21D 17/054

[52] U.S. Cl. ..... 405/293

[58] Field of Search ..... 405/291, 293, 294; 248/354 H, 357; 299/31, 33

[56] References Cited

U.S. PATENT DOCUMENTS

| | | | |
|---|---|---|---|
| 3,686,874 | 8/1972 | Bell | 405/293 |
| 4,124,984 | 11/1978 | Saunders | 405/293 |
| 4,155,676 | 5/1979 | Friedrichs | 405/293 |

FOREIGN PATENT DOCUMENTS

| | | | |
|---|---|---|---|
| 717367 | 2/1980 | U.S.S.R. | 405/293 |

*Primary Examiner*—David H. Corbin

*Attorney, Agent, or Firm*—Sughrue, Mion, Zinn, Macpeak & Seas

[57] ABSTRACT

A mine roof support unit has a mechanism for adjusting the angular position of an auxiliary cap relative to a main cap, the auxiliary cap and the main cap forming the roof cap of the mine roof support unit. The auxiliary cap is connected to the main cap by a first pivot joint. The cap-positioning mechanism comprises a hydraulic ram and a lever acting between the main cap and the auxiliary cap. The auxiliary cap is provided with an extension arm projecting from the first pivot joint towards the main cap. One end portion of the lever is connected to the arm by a second pivot joint, and the other end of the lever is connected to a block attached to the piston rod of the ram by a third pivot joint. The cylinder of the ram is attached to the main cap.

18 Claims, 3 Drawing Figures

CAP POSITIONING MECHANISM

BACKGROUND TO THE INVENTION

This invention relates to a mechanism for adjusting the angular position of an auxiliary cap relative to a main cap, the auxiliary cap and the main cap constituting the roof cap of a mine roof support unit.

A cap-positioning mechanism is used in a mine roof support unit of the type having an auxiliary cap (for example, a front extension cap) pivotally connected to a main cap. The auxiliary cap and the main cap constitute the roof cap of the unit, the main cap being supported above a floor sill by means of hydraulic props. The cap-positioning mechanism of such a unit includes a hydraulic ram attached to the main cap, and acting on the auxiliary cap.

A known type of cap-positioning mechanism has the hydraulic ram arranged immediately below the main cap. The piston rod of the ram engages a slide which is guided by means of slide blocks mounted in elongate recesses formed in the main cap. The front end of the slide is connected to the auxiliary cap by means of levers, the levers being pivotally connected to both the slide and the auxiliarty cap. The pivotal connections between the auxiliary cap and levers are positioned forwardly of the pivot joint connecting the auxiliary cap to the main cap. Such a cap-positioning mechanism is complicated and expensive. Moreover, it needs a hydraulic ram having a long working stroke. A mechanism of this type is described in DE-GM No. 1965204.

In another known arrangement, the auxiliary cap is constituted by a double-armed lever. One of the arms carries a plate to constitute the auxiliary cap, and the other arm is engaged by the piston rod of the ram. The ram is inclined, and its cylinder is fixed to the main cap. The disadvantage of this type of mechanism is that, owing to the inclination of its ram, a lot of the valuable space underneath the roof cap is occupied. A mechanism of this type is described in DE-GM No. 7020789.

The aim of the invention is to provide a cap-positioning mechanism which is simple, robust, and can be incorporated in the roof cap of a mine roof support unit in a space-saving manner.

SUMMARY OF THE INVENTION

The present invention provides a cap-positioning mechanism for adjusting the angular position of an auxiliary cap relative to a main cap, the auxiliary cap and the main cap constituting the roof cap of a mine roof support unit, the auxiliary cap being connected to the main cap by a first pivot joint, the mechanism comprising a hydraulic ram and a lever acting between the main cap and the auxiliary cap, wherein the auxiliary cap is provided with an extension arm projecting from the first pivot joint towards the main cap, one end portion of the lever being connected to the arm by a second pivot joint, and the other end of the lever being connected to a first part of the ram by a third pivot joint, a second part of the ram being attachable to the main cap, the first and second parts of the ram being relatively movable.

With this mechanism, the hydraulic ram can be housed within the main cap if, as usual, the main cap is of box-girder or U-shaped construction. High forces can be applied to the auxiliary cap via the lever and the rear end of the arm. The relatively short lever is also largely housed within the main cap. Moreover, the hydraulic ram can be one having a short working stroke, and the auxiliary cap can be pivoted between a position in which it is upwardly angled by 10° to 15° relative to the main cap, and a position in which it is downwardly angled by 5° to 10° relative to the main cap. In this case, the lever can be particularly short.

Advantageously, the first part of the ram is a piston rod, and the second part of the ram is a cylinder In this case, an intermediate member may be attached to the piston rod, and said other end of the lever may be connected to the intermediate member by the third pivot joint.

Preferably, the second pivot joint is constituted by a rounded formation at said one end of the lever, and by a complementary cup-shaped socket formed in the arm. Conveniently, the second pivot joint is secured by a pivot pin passing through said one end of the lever and the arm.

The mechanism may further comprise a second lever one end of which is connected to the first part of the ram by the third pivot joint, the other end of the second lever being connectible to the main cap by a fourth pivot joint. Advantageously, the fourth pivot joint is constituted by a rounded formation at said other end of the lever, and by a complementary cup-shaped socket formed in a block attachable to the main cap. Preferably, the fourth pivot joint is secured by a pivot pin passing through said other end of the second lever and the block.

The invention also provides a roof cap for a mine roof support unit, the roof cap comprising a main cap, an auxiliary cap connected to the main cap by a first pivot joint, and a cap-positioning mechanism for adjusting the angular position of the auxiliary cap relative to the main cap, wherein the mechanism is as defined above.

Preferably, the main cap is of hollow box-girder construction, and wherein the hydraulic ram and the first-mentioned lever are housed within the hollow interior of the main cap. Where the mechanism includes a second lever, the second lever may be housed within the hollow interior of the main cap.

Where the second lever is not present, the intermediate member may be so shaped and sized to slide within the main cap, the upper and lower surfaces of the intermediate member being in slidable contact respectively with the underneath side of the upper wall of the main cap and with the top side of the lower wall of the main cap.

Advantageously, the arm and the main cap are formed with complementary abutment surfaces which are engageable to limit the angle through which the auxiliary cap can pivot relative to the main cap. Preferably, the abutment surface of the arm is constituted by an inclined upper surface thereof, and the abutment surface of the main cap is constituted by an inclined end surface thereof.

BRIEF DESCRIPTION OF THE DRAWINGS

The invention will now be described in greater detail, by way of example, with reference to the accompanying drawings, in which.

DESCRIPTION OF PREFERRED EMBODIMENTS

Figure 1:
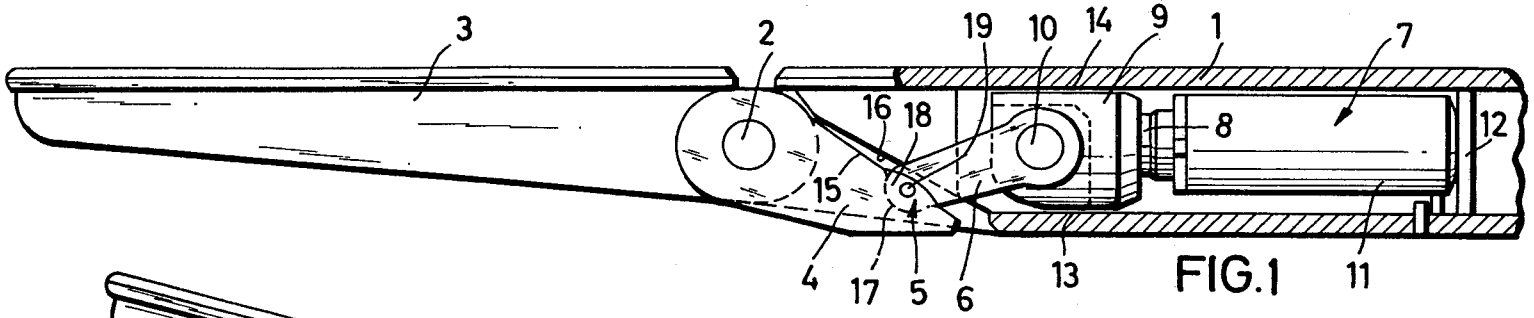
FIG. 1 is a part-sectional side elevation of a portion of the roof cap of a mine roof support unit, the roof cap having a main cap, an auxiliary cap pivotally connected to the main cap, and a cap-positioning mechanism constructed in accordance with the invention.

Referring to the drawings, FIG. 1 shows the front (face-side) portion of the roof cap of a mine roof support unit. The roof cap has a main cap 1 which is supported by the hydraulic props (not shown) of the roof support unit. An auxiliary (forward extension) cap 3 is pivotally connected to the front edge of the main cap 1 by means of a pivotal connection 2. The main cap 1 is of hollow box-girder construction. The auxiliary cap 3 is provided with an integral, rearwardly-extending arm 4 (that is to say the arm 4 extends rearwardly from the pivotal connection 2 towards the main cap 1). Instead of being integrally formed with the auxiliary cap 3, the arm 4 could be a separate part fixed to the auxiliary cap. It is also possible for the auxiliary cap 3 to be a rear extension cap of the main cap 1, instead of being a foward extension cap.

The free end of the arm 4 is pivotally connected, by means of a pivot joint 5, to one end of a lever 6. The other end of the lever 6 is pivotally connected, by means of a pivot joint 10, to a slide block 9. The slide block 9 is fixed to the piston rod 8 of a hydraulic ram 7 which is housed within the hollow main cap 1. The hydraulic ram 7 is arranged within the main cap 1 in such a manner that the direction of its working stroke is substantially parallel to the main cap and towards the front. The axes of the pivot joints 2, 5 and 10 are parallel. The pivot joint 5 is constituted by a cup-shaped socket 17 formed in the arm 4, a rounded end portion 18 of the lever 6 which engages within the socket, and a pivot pin 19 which secures the lever to the arm.

The cylinder 11 of the hydraulic ram 7 is provided with an abutment constituted by a web 12 inside the main cap 1. The slide block 9 is sized and shaped to slide within the main cap 1; with its lower surface in sliding contact with a lower slide surface 13 defined by the top side of the lower wall of the main cap, and with its upper surface in sliding contact with an upper slide surface 14 defined by the underneath side of the upper wall of the main cap.

Figure 2:
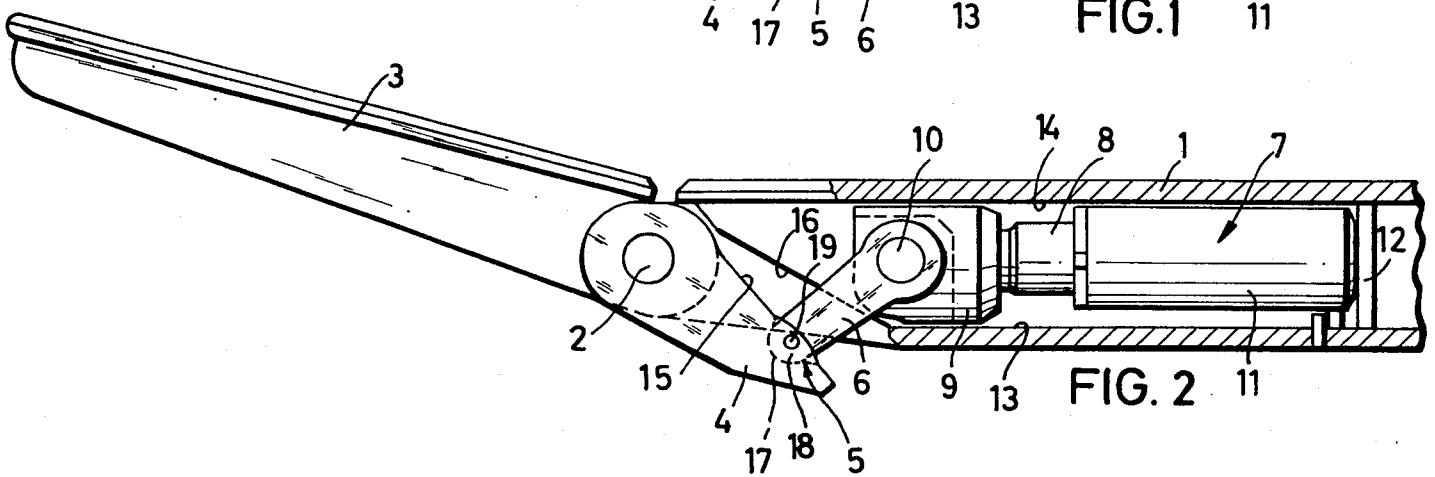
FIG. 2 is similar to FIG. 1, but shows the auxiliary cap in a different position relative to the main cap.

FIG. 1 shows the roof cap with the auxiliary cap 3 in the same plane as the main cap 1. In this position, the ram 7 is partially extended. If the ram 7 is now further extended, its piston rod 8 is moved outwards. This causes outward movement of the slide block 9, which leads to anti-clockwise pivotal movement of the lever 6 (as seen in FIGS. 1 and 2), and hence clockwise pivotal movement of the auxiliary cap 3. Thus, the auxiliary cap 3 pivots upwardly relative to the main cap 1. FIG. 2 shows the roof cap in the position where the ram 7 is fully extended, in which case the auxiliary cap 3 lies at an angle of about 15° to the main cap 1. By retracting the ram 7, the auxiliary cap 3 can be pivoted down from the position shown in FIG. 2. When the ram 7 is fully retracted, the auxiliary cap 3 lies at an angle of about 5° to the main cap 1, but is downwardly inclined relative thereto. In this position, in which the auxiliary cap 3 is fully downwardly pivoted, an inclined upper surface 15 of the arm 4 bears against an inclined lower surface 16 formed on the end face of the main cap 1. In this position, the lever 6 and the ram 7 are not subjected to loads applied down onto the auxiliary cap 3.

Figure 3:
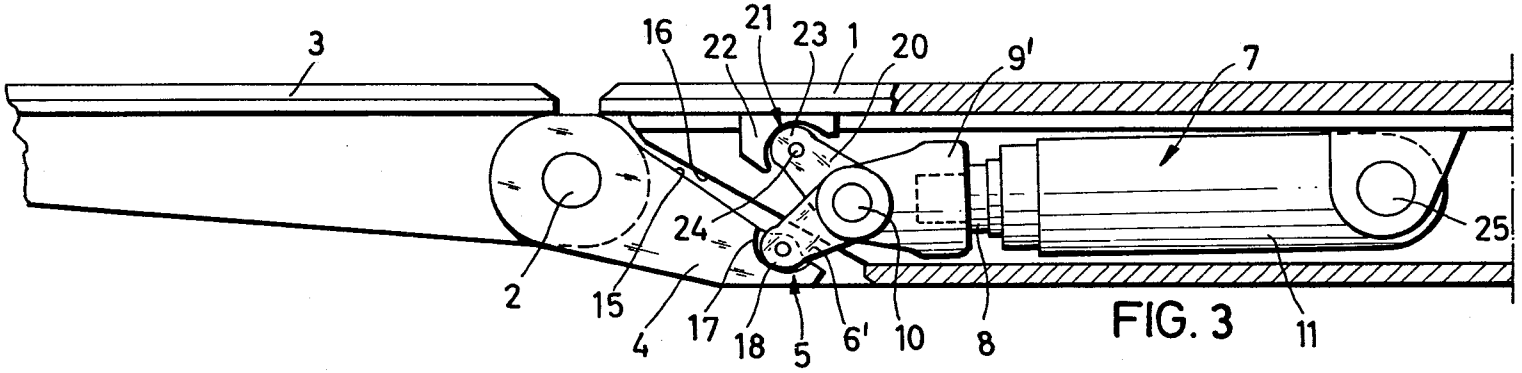
FIG. 3 is a part-sectional side elevation similar to that of FIG. 1, but shows a modified form of cap-positioning mechanism.

FIG. 3 shows a roof cap which is basically the the same as that of FIGS. 1 and 2, and so like reference numerals have been used for like parts. The difference between the two embodiments lies in the connections between their piston rods 8 and their arms 4. Thus, in the FIG. 3 embodiment, the piston rod 8 is fixed to a stub head 9′, and this stub head is joined to the arm 4 by a toggle lever. The toggle lever has two levers 6′ and 20; the lever 6′ being similar to the lever 6 of the embodiment of FIGS. 1 and 2, and being pivotally connected to the arm 4 and the stub head 9′ by respective pivot joints 5 and 10. The other lever 20 is also pivotally connected, at one end, to the stub head 9′ by means of the pivot joint 10. The other end of the lever 20 is pivotally connected, by means of a pivot joint 21, to a block 22 fixed to the underneath side of the upper wall of the main cap 1. The pivot joint 21 is constituted by a cup-shaped socket formed in the block 22, a rounded end portion 23 of the lever 20 which engages with the socket, and a pivot pin 24 which secures the lever 20 to the block.

Because of the support supplied by the toggle lever 6′, 20, there is no need for the stub head 9′ to make sliding contact with the hollow main cap 1. Consequently, the stub head 9′ is shaped and sized to form a clearance with the underneath side of the upper wall and the top side of the lower wall of the main cap 1.

Another difference between the embodiments of FIG. 3 and FIGS. 1 and 2 is that the cylinder 11 of the ram 7 of the FIG. 3 embodiment is attached, at 25, to the inside of the main cap 1. Obviously the cylinder 11 of the embodiment of FIGS. 1 and 2 could also be fixed to the main cap 1 in this manner.

It will be apparent that, in both embodiments, the ram 7, the slide block 9 (or the stub head 9′), and the lever 6 (or the toggle lever 6′, 21) are housed within the protective cover of the main cap 1 in a space-saving manner. Moreover, in each case, the arm 4 is also mainly housed within the protective cover of the main cap 1.

We claim:

1. A cap-positioning mechanism for adjusting the angular position of an auxiliary cap relative to a main cap, the auxiliary cap and the main cap comprising the roof cap of a mine roof support unit, the auxiliary cap being connected to the main cap by a first pivot joint, the mechanism comprising a hydraulic ram and a lever acting between the main cap and the auxiliary cap, wherein the auxiliary cap is provided with an extension arm projecting from the first pivot joint towards the main cap, one end portion of the lever being connected to the arm by a second pivot joint, and the other end of the lever being connected to a first part of the ram by a third pivot joint, the lever having a length which is less than the distance between the first pivot joint and the third pivot joint, a second part of the ram being attachable to the main cap, the first and second parts of the ram being relatively movable.

2. A roof cap for a mine roof unit, the roof cap comprising a main cap, an auxiliary cap connected to the main cap by a first pivot joint, and a cap-positioning mechanism for adjusting the angular position of the auxiliary cap relative to the main cap, the mechanism comprising a hydraulic ram and a lever acting between the main cap and the auxiliary cap, wherein the auxiliary cap is provided with an extension arm projecting from the first pivot joint towards the main cap, one end portion of the lever being connected to the arm by a second pivot joint, and the other end of the lever being connected to a first part of the ram by a third pivot joint, the lever having a length which is less than the distance between the first pivot joint and the third pivot joint, a second part of the ram being attached to the main cap, the first and second parts of the ram being relatively movable.

3. A roof cap according to claim 2, wherein the first part of the ram is a piston rod, and the second part of the ram is a cylinder.

4. A roof cap according to claim 3, wherein an intermediate member is attached to the piston rod, and said other end of the lever is connected to the intermediate member by the third pivot joint.

5.A roof cap according to claim 3, wherein the second pivot joint comprises a rounded formation at said one end of the lever, and a complementary cup-shaped socket formed in the arm.

6. A roof cap according to claim 5, wherein the second pivot joint is secured by a pivot pin passing through said one end of the lever and the arm.

7. A roof cap according to claim 2, further comprising a second lever one end of which is connected to the first part of the ram by the third pivot joint, the other end of the second lever being connected to the main cap by a fourth pivot joint.

8. A roof cap according to claim 7, wherein the fourth pivot joint comprises a rounded formation at said other end of the second lever, and a complementary cup-shaped socket formed a block attached to the main cap.

9. A roof cap according to claim 8, wherein the fourth pivot joint is secured by a pivot pin passing through said other end of the second lever and the block.

10. A roof cap according to claim 3, wherein the main cap is of hollow box-girder construction, and wherein the hydraulic ram and the first-mentioned lever are housed within the hollow interior of the main cap.

11. A roof cap according to claim 7, wherein the main cap is of hollow box-girder construction, and wherein the second lever is housed within the hollow interior of the main cap.

12. A roof cap according to claim 4, wherein the main cap is of hollow box-girder construction having an upper wall, a lower wall, and a pair of side walls, and wherein the intermediate member is shaped and sized to slide within the main cap, the upper and lower surfaces of the intermediate member being in slidable contact respectively with the underneath side of the upper wall of the main cap and with the top side of the lower wall of the main cap.

13. A roof cap according to claim 2, wherein the arm and the main cap are formed with complementary abutment surfaces which are engagable to limit the angle through which the auxiliary cap can pivot relative to the main cap.

14. A roof cap according to claim 13, wherein the abutment surface of the arm is an inclined upper surface thereof, and the abutment surface of the main cap is an inclined end surface thereof.

15. A roof cap for a mine roof support unit, the roof cap comprising a main cap, an auxiliary cap connected to the main cap by a first pivot joint, and a cap-positioning mechanism for adjusting the angular position of the auxiliary cap relative to the main cap, the mechanism comprising a hydraulic ram and a lever acting between the main cap and the auxiliary cap, wherein the auxiliary cap is provided with an extension arm projecting from the first pivot joint towards the main cap, one end portion of the lever being connected to the arm by a second pivot joint, and the other end of the lever being connected to a first part of the ram by a third pivot joint, a second part of the ram being attached to the main cap, the first and second parts of the ram being relatively movable; and said roof cap further comprising a second lever one end of which is connected to the first part of the ram by the third pivot joint, the other end of the second lever being connected to the main cap by a fourth pivot joint.

16. A roof cap according to claim 15, wherein the fourth pivot joint comprises a rounded formation at said other end of the second lever, and a complementary cup-shaped socket formed in a block attached to the main cap.

17. A roof according to claim 16, wherein the fourth pivot joint is secured by a pivot pin passing through said other end of the second lever and the block.

18. A roof cap according to claim 15, wherein the main cap is of hollow box-girder construction, and wherein the second lever is housed within the hollow interior of the main cap.

* * * * *